US006029834A

United States Patent [19]

Sanner

[11] Patent Number: 6,029,834

[45] Date of Patent: Feb. 29, 2000

[54] CHILDPROOF AND TAMPER-PROOF CONTAINER CLOSURE FOR CONTAINERS

[75] Inventor: Jürgen Sanner, Bensheim, Germany

[73] Assignee: Friedrich Sanner GmbH & Co. KG, Germany

[21] Appl. No.: 09/181,187

[22] Filed: Oct. 28, 1998

[30] Foreign Application Priority Data

Apr. 22, 1998 [DE] Germany ..... 298 07 243

[51] Int. Cl.[7] ..... B65D 50/04; B65D 41/34

[52] U.S. Cl. ..... 215/215; 215/220; 215/251; 215/252

[58] Field of Search ..... 215/204, 207, 215/215, 217, 220, 250, 251, 252, 253, 257, 277, 301, 302, 303; 81/3.45, 3.29, 3.36, 3.33, 3.09, 3.15

[56] References Cited

U.S. PATENT DOCUMENTS

| | | | |
|---|---|---|---|
| 3,944,102 | 3/1976 | Grau | 215/220 X |
| 4,014,449 | 3/1977 | Hadley et al. | 215/215 |
| 4,281,771 | 8/1981 | Siegel | 215/220 |
| 4,562,931 | 1/1986 | Brach et al. | 215/220 |
| 4,598,833 | 7/1986 | Herr | 215/220 |
| 4,673,095 | 6/1987 | Puresevic et al. | 215/220 |
| 4,801,028 | 1/1989 | Puresevic et al. | 215/220 |
| 5,005,718 | 4/1991 | Buono | 215/220 |
| 5,590,799 | 1/1997 | King | 215/220 X |
| 5,762,215 | 6/1998 | Ogden | 215/220 |

*Primary Examiner*—Nathan J. Newhouse
*Attorney, Agent, or Firm*—Londa and Traub LLP

[57] ABSTRACT

A childproof and tamper-proof closure for a container has an outer cap which can be twisted relative to the inner cap and can be shifted axially. Coupling projections on each of the caps can be brought into and out of engagement by the axial displacement of the outer cap with respect to the inner cap. Break-off elements include a breakout projection protruding from the inner cap in a direction away from the container and towards the outer cap; a break-off region attached to the outer cap so that the break-off region is forcibly detached from the outer cap by the breakout projection when the coupling projections are brought into engagement for the first time; a second break-off region attached to the inner cap, a free end of the break-off region extending below an annular protrusion integrally molded around the neck of the container when the cap is fastened on the mouth of the container; and at least one gripping projection on the second break-off region extending inwardly below the annular protrusion when the cap is fastened on the mouth of the container. The second break-off region detaches from the inner cap as the inner cap is rotatably unfastened from the mouth of the container for the first time by rotating the outer cap when the coupling projections are in engagement, so as to rotate the inner cap.

2 Claims, 2 Drawing Sheets

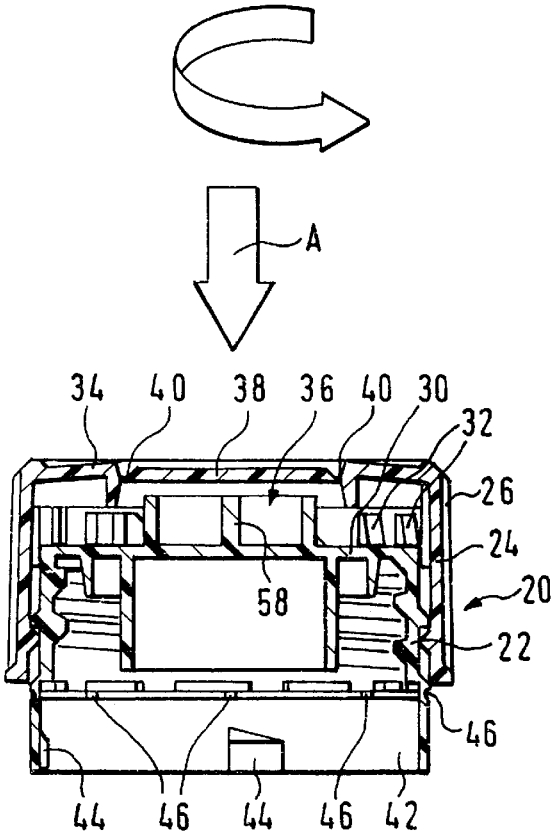
Fig. 2a
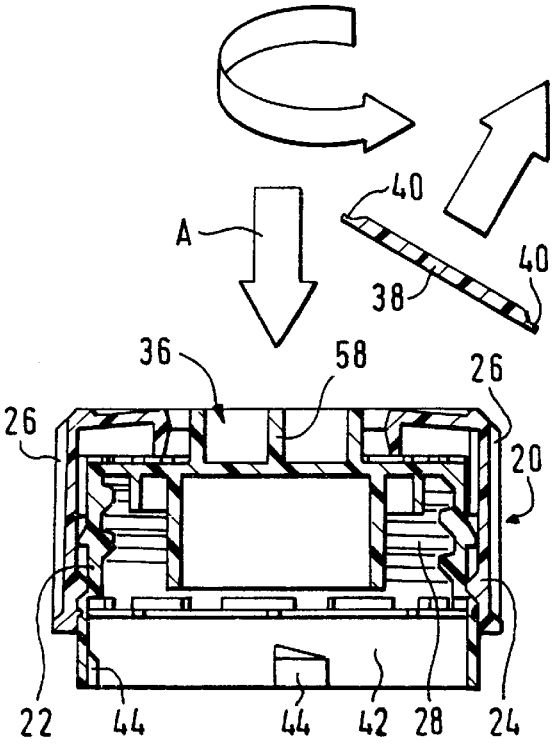
Fig. 2b
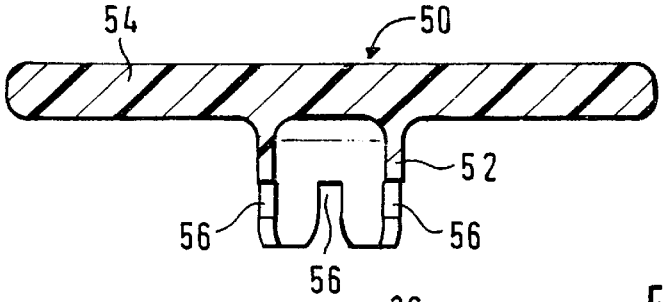
Fig. 2c
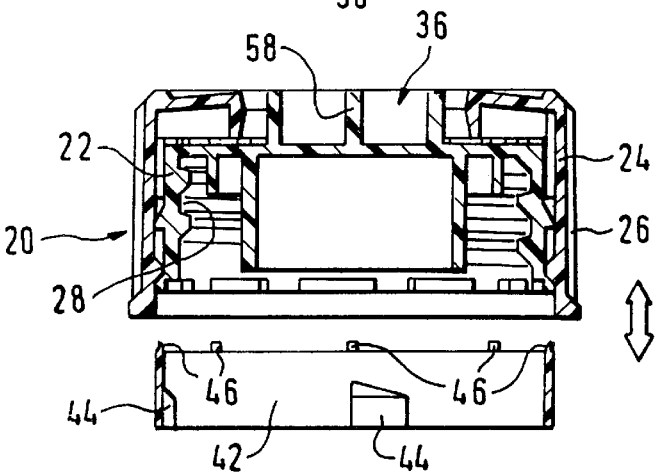

CHILDPROOF AND TAMPER-PROOF CONTAINER CLOSURE FOR CONTAINERS

BACKGROUND OF THE INVENTION

1. Field of the Invention

The invention relates to a childproof and tamper-proof closure for containers, especially for medicines and/or chemicals, with an inner cap, which can be fastened on the mouth of the container by turning and removed from the container by turning it in the opposite direction and on which an outer cap is disposed, which covers the inner cap, can be twisted relative to it and can be shifted axially to it at right angles to the direction of rotation by a given amount, coupling projections, which can brought into engagement with one another in complementary fashion by the axial displacement of the outer cap on the inner cap in the direction of the interior of the container and, by the opposite axial displacement, on the other hand, be brought out of engagement with one another, being disposed on the inner cap and the outer cap, and a guarantee region, which interacts with at least one stop element or shear-off element, which is provided at the inner cap or at the mouth of the container, in such a manner, that the guarantee region is severed from the cap, to which it is integrally molded, already when the container is opened for the first time, being integrally molded at one of the caps of the closure over one or more break-off region or regions.

2. Description of the Related Art

Such screw cap closures, which are childproof as well as tamper proof are known in different forms. The childproof closures generally are constructed that, for unscrewing the closure, the outer cap must be compressed in the axial direction against the force of a spring holding the end faces of the outer and inner caps at a distance from one another, in order to bring the coupling projections into engagement in this way, which transfer a rotary motion, exerted on the outer cap, onto the inner cap. Two different tamper-proof systems have become known. For the one system, a locking ring is integrally joined over break-off cross members or a peripherally extending break-off seam to the edge of the inner cap on the container side and, with an annular ring protruding inwards, that is, to the neck of the container, or individual, inwardly protruding projections distributed in the circumferential direction, grip below a ring projection at the neck of the container. When this closure is unscrewed with the outer cap compressed, the inner cap unscrews from the thread of the neck of the container. The annular ring or the projections at the locking ring do not permit an axial displacement over the ring projection provided at the neck of the container, so that, in the region of the break-off cross members or the break-off seam, the locking ring tears off from the inner cap (U.S. Pat. Nos. 4,570,809 and 4,474,301). The other known tamper-proof system is based on the fact that, by means of a peripheral seam of weakness or individual break-off cross members in the end wall of the outer cap, an end wall section is formed, which can be broken out and is confronted by a projection protruding from the outer side of the end wall of the inner cap. If, for the purpose of a coupling engagement with the inner cap, the outer cap is pressed down in the axial direction, the end wall section, which can be broken out, comes to lie against the projection, is broken out upon further pressure and falls off from the outer cap, so that an opening is formed in the end wall, which indicates that at least the attempt has been made to open the closure (U.S. Pat. Nos. 4,801,028 and 4,669,620). The two tamper-proof systems described above are based on the fact that, when the closure is opened, an originally integral part of the closure necessarily is torn off or sheared off. However, practical experience has shown that a tamper-proof system, which is based on a locking ring that can be torn off, is not manipulation-proof in all cases. Especially when the plastic material of the inner cap is sufficiently elastic, the closure can be levered without tearing off the locking ring with elastic expansion over the annular protrusion at the neck of the container, the locking ring not being torn off. It is conceivable that the contents of the container can be removed and be replaced with a different product of lower value. On the other hand, the system with the end wall section, which can be broken out, has the disadvantage that the end wall section is broken out unintentionally without actually opening the container. For example, when the container is taken hold of clumsily, pressure can be exerted on the end wall of the outer cap and force open the end wall section without there having been access to the contents of the container. Such a container is then no longer saleable or the contents, contained therein, cannot be used for safety reasons, although they are still the original contents.

SUMMARY OF THE INVENTION

It is an object of the invention to improve the known child-proof, screw cap closures with respect to reliably recognizing any unauthorized opening. At the same time, the closures should also be constructed so that the screwing on and the unscrewing of the rotary cap is facilitated to such an extent, that even older and weakened persons can open and close the closure, without impairing the childproofness function.

Starting out from a container closure of the type mentioned above, this objective is accomplished pursuant to the invention owing to the fact that two tamperproof systems are provided, which are functionally independent of one another, one of which is formed by a locking ring, which is known as such, is fastened over break-off cross members or over a peripheral seam of material of decreased thickness integrally to the edge of the inner cap on the container side and has at least one projection, which protrudes to the neck of the container and grips behind the annular protrusion that is molded integrally to the neck of the container, the other projection being formed by an end-wall section, which is known as such, is held in the end wall of the outer cap by a peripheral, annular weakness seam or individual break-off cross members in such a way that it can be broken out and is opposite to a projection, which protrudes from the end wall of the inner cap and which, when the end wall section of the outer cap, which can be broken out, is shifted axially relative to the inner cap for the purpose of establishing the coupling engagement between the two caps before the screw top is unscrewed from the container, breaks out said end wall section of the outer cap, which can be broken out, from the end wall of the outer cap. By combining the two tamper-proof systems, which are known as such, it is achieved that, when the cap is screwed completely from the container closure, at first the end wall section is pressed out of the outer cap and subsequently, during the unscrewing, the locking ring is then torn from the inner cap. Since these two systems become effective under different manipulation conditions, namely the impression of the outer cap on the one hand and the unscrewing of the closure on the other, a manipulation of such a kind, that the closure can be opened without visible damage, is practically excluded.

In an inventive, further development, the free end region of the projection, protruding from the end wall of the inner cap, can have a tool application seat, which is not exclusively circular in cross section, in which case a separate opening aid can then be provided with a shoulder, which is shaped at its free end in a fashion complementary to the tool application seat of the projection and, in the axial direction, can be placed on or removed from the projection on the inner cap but, in the placed-on state, brings about a rotation-resistant connection with the projection. In this connection, the tool application seat can be formed, for example, by a protruding square or polyhedral head or also by a depression in the form of a screwdriver slot of a hexagonal recess. The opening aid then corresponds to a wrench. The force required for opening and closing the container closure is reduced considerably by means of a suitable design of the handle of the opening aid, for example, as a lever arm fastened to the shoulder or as a non-slip flat plate of large diameter. Since the opening aid engages the inner cap directly, there is also no need to exert additional axial pressure on the outer cap during the closing or opening, in order to couple the inner and outer caps.

BRIEF DESCRIPTION OF THE DRAWINGS

The invention is explained in greater detail in the following description of an example in conjunction with the drawing, in which FIGS. 1*a* to 1*c* in each case show a side view of a container, which can be closed off by an inventive container closure, the closure, constructed as a screw cap closure, being shown in different opening positions and FIGS. 2*a*, 2*b* and 2*c* in each case show a perpendicular longitudinal section through the center of the closure, also in different opening positions.

DESCRIPTION OF THE PREFERRED EMBODIMENTS

Figure 1A:
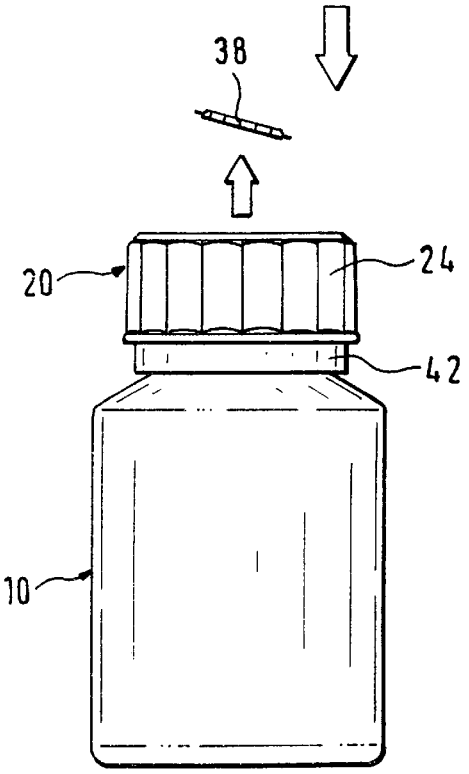
Figure 1B:
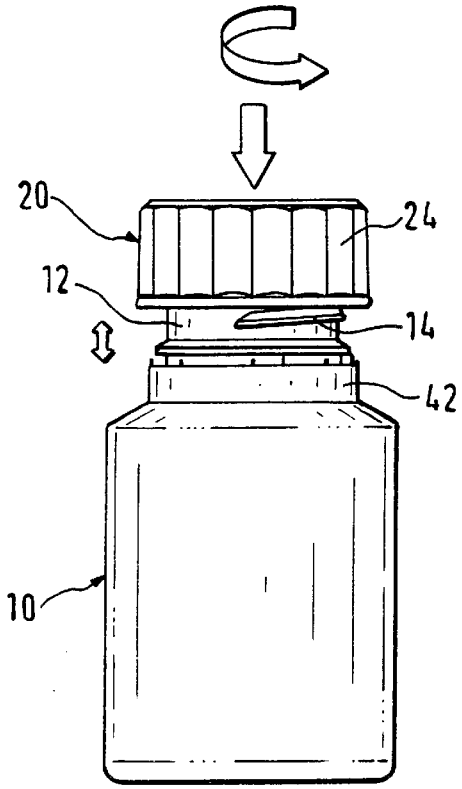
Figure 1C:
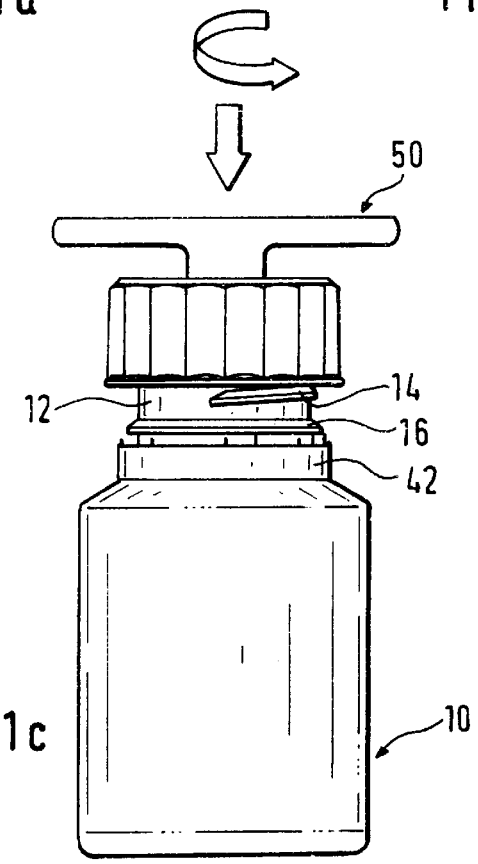

In the case presented, the container 10, shown in FIGS. 1*a* to 1*c*, is a small bottle, which is provided on the outside of its neck 12, the diameter of which is reduced, with a screw thread 14 and is used for bottling medicines, chemicals, etc. A peripheral annular projection 16 is provided at the container neck below the screw thread. The closure, which is labeled 20 as a whole, is constructed in the inventive manner and consists of two parts, namely an inner cap 22, which can be screwed onto the screw thread 14 and an outer cap 24, which overlaps the inner cap 22 and determines the outer appearance of the closure and which, to increase the non-slip properties, is provided on its outer, cylindrical, peripheral surface in the usual manner with longitudinally extending low ribs 26. At its upper end, adjoining the peripheral surface, which is provided with the internal thread 28 that is complementary to the screw thread 14, the inner cap 22 has an end wall 30, from which locking projections 32 (FIG. 2*a*) protrude in the radial outer region. Complementary locking projections protrude from the inside of the end wall 34 in the downwards direction. However, in the starting position shown in FIG. 2*a*, they do not engage the locking projections 32, because the outer cap 24 is lifted by an amount corresponding to the height of the locking projections from the end wall 30 of the inner cap 22. Only when a pressure is exerted in the direction of the arrow, which is labeled A in FIGS. 2*a* and 2*b*, is the outer cap 24 shifted in the downwards direction and the locking projections 32 mentioned engage the locking projections (not shown) at the end wall 34 of the outer cap. At the same time, a projection 36, centrally protruding from the upper side of the end wall 30 of the inner cap, then comes also into contact with the inner side of the end wall 34 of the outer cap and does so, moreover, in the region of a central end wall section 38, which is held in the end wall 34 by break-off cross members 40. When the outer cap 24 is depressed, this end wall section 38 is broken off from the projection 36 and out of the end wall 34, as illustrated in FIG. 2*b*. At the same time, the outer cap 24 is also brought into coupling engagement with the inner cap 22. If then the outer cap is turned in the opening direction, the inner thread 28 of the inner cap 22 is unscrewed from the outer thread 14 of the neck 12 of the container and inner and outer caps are unscrewed axially from the neck 12 of the container.

At its lower edge region averted from the end wall, the inner cap 22 is provided with an integrally joined locking ring 42 with inwardly protruding locking projections 44. The locking ring 42 is tied to the inner cap only over a number of thin break-off cross members 46, which are distributed in the circumferential direction. When the inner cap is unscrewed, the projections 44, gripping behind the annular projection 16 at the neck 12 of the container, come to lie against the container-side boundary wall of the annular projection 16 and the ring is held positively against a displacement component in the opening direction of the container. When the inner cap is unscrewed from the neck 12 of the container, the locking ring 42 is sheared off from the inner cap along the break-off cross members 46, as is illustrated in FIG. 2*c*.

It is thus clear that, when the container 10 is opened for the first time by unscrewing the container closure 20, which is constructed as a screw cap closure, at first the end wall section 38 is broken out of the end wall 34 of the outer cap and then, during the unscrewing from the neck of the container, the locking ring 42 is sheared off from the inner cap. It is thus obviously indicated in two ways when the container closure has already been opened.

In the case shown, the projection 36, which protrudes from the end wall 30 of the inner cap 22, is constructed as a hollow cylindrical projection, which is open at the end averted from the container and the interior of which is divided by a radially extending transverse wall 48. In FIGS. 1*c* and 2*c*, an opening aid 50 is shown diagrammatically. It is formed by a central, cylindrical projection 52, which can be introduced into and fits into the interior of the projection 36, and has a handle 54, which is in the shape of a double lever and is joined at the upper end, averted from the closure. The wall of the cylindrical projection 52 is provided with slots 56, which open up at the underside facing the container and which, when the opening aid 50 is set against the projection 36, grip the transverse wall 48 and thus produce a rotation-resisting connection between the opening aid 50 and the inner cap 22.

It is clear that the handle 54 of the opening aid 50 can also be constructed differently, for example, as a rotary knob of large diameter with a non-slip peripheral surface or as a one-arm lever. Projection 52 can also be rotationally coupled with projection 36 in any other suitable (known) manner. For example, projection 36 can be constructed as a polyhedral head corresponding to the head of a screw, in which case projection 52 then has a seat, which fits on the polyhedral head and corresponds to the head of a wrench.

It should furthermore be noted that the inventive embodiment of the container closure is not limited to those screw cap closures, for which the inner cap is fastened with a screw thread on a complementary thread of the neck of the container. Alternatively, other rotational connections, such as a quarter-turn fastener, may also be provided.

I claim:

1. A childproof and tamper-proof closure for a container, comprising:

an inner cap rotatably fastenable on a mouth of the container an outer cap disposed on said inner cap, wherein said outer cap can be twisted relative to said inner cap and can be shifted axially by a given amount relative to said inner cap;

coupling projections on each of said inner and outer cap which can be brought into engagement with one another in complementary fashion by the axial displacement of the outer cap with respect to the inner cap in the direction of the interior of the container and, can be brought out of engagement from one another by the opposite axial displacement of the outer cap with respect to the inner cap;

a breakout projection protruding from said inner cap in a direction away from said container and towards said outer cap;

a break-off region attached to said outer cap wherein said break-off region is forcibly detached from said outer cap by said breakout projection when said coupling projections are brought into engagement for the first time;

a second break-off region having a lower free end attached to said inner cap, said lower end for extending below an annular protrusion integrally molded around the neck of said container when the cap is fastened on the mouth of the container; and at least one gripping projection on said second break-off region extending inwardly below said annular protrusion when the cap is fastened on the mouth of the container;

wherein said second break-off region detaches from said inner cap when said inner cap is rotatably unfastened from the mouth of the container for the first time by rotating said outer cap when said coupling projections are in engagement, thereby rotating said inner cap.

2. The container closure of claim 1, wherein said breakout projection further comprises a tool application seat for accommodating a separate opening aid, said separate opening aid being shaped at its free end in a fashion complementary to the tool application seat of the projection for attaching onto said projection in the axial direction, thereby establishing a rotation-resistant connection with the projection.

* * * * *